US005209565A

United States Patent [19]

Goncalves

[11] Patent Number: 5,209,565

[45] Date of Patent: May 11, 1993

[54] ASSEMBLY ADAPTED FOR THE MIXING OF TWO DIFFERENT PRODUCTS STORED SEPARATELY

[75] Inventor: Antonin Goncalves, Montmorency, France

[73] Assignee: L'Oreal, Paris, France

[21] Appl. No.: 811,436

[22] Filed: Dec. 23, 1991

[30] Foreign Application Priority Data

Dec. 20, 1991 [FR] France ..... 9115929

[51] Int. Cl.[5] ..... B65D 25/08; B65D 81/32

[52] U.S. Cl. ..... 366/130; 141/319; 141/364; 141/366; 141/375; 206/219; 206/220; 206/221; 215/DIG. 8; 220/23.86; 222/83.5

[58] Field of Search ..... 206/219-222; 215/DIG. 8; 366/129-130, 342, 349, 602; 220/23.83, 23.86, 4.21, 501, 502; 141/319, 320, 375, 363, 364, 366; 222/81-83.5, 541

[56] References Cited

U.S. PATENT DOCUMENTS

| | | | |
|---|---|---|---|
| 675,971 | 6/1901 | Raymond, II | 206/219 |
| 1,000,484 | 8/1911 | Auchu | 206/219 |
| 3,261,381 | 7/1966 | Roach | 206/219 X |
| 3,809,289 | 5/1974 | Komendowski . | |
| 3,917,063 | 11/1975 | Chibret et al. | 222/83 X |
| 4,008,803 | 2/1977 | Smith . | |
| 4,386,696 | 6/1983 | Goncalres | 206/219 X |
| 4,573,506 | 3/1986 | Paoletti | 141/319 X |
| 4,614,437 | 9/1986 | Buehler | 366/130 |
| 4,779,991 | 10/1988 | Kitamura | 366/130 |
| 4,852,742 | 8/1989 | Scuorzo | 206/219 X |
| 4,986,322 | 1/1991 | Chibret et al. | 215/DIG. 8 X |
| 5,027,872 | 7/1991 | Taylor et al. | 206/219 X |

FOREIGN PATENT DOCUMENTS

| | | | |
|---|---|---|---|
| 0138681 | 4/1985 | European Pat. Off. . | |
| 0279546 | 8/1988 | European Pat. Off. . | |
| 2433716 | 1/1976 | Fed. Rep. of Germany | 206/219 |
| 3631141 | 3/1988 | Fed. Rep. of Germany . | |
| 8811084 | 12/1989 | Fed. Rep. of Germany . | |
| 2212817 | 7/1974 | France . | |
| 2476607 | 8/1981 | France | 206/219 |

*Primary Examiner*—Harvey C. Hornsby
*Assistant Examiner*—Charles Cooley
*Attorney, Agent, or Firm*—Cushman, Darby & Cushman

[57] ABSTRACT

An assembly for the mixing of two different products stored separately. The assembly comprises a first and second container, the first container having a neck and a body. The neck of the first container having a tearable cap and the body being responsive to manual pressure to effect the dispensing of the product from the first container after the cap is torn. A rigid second container has a neck to which a first cap is attachable. The first cap has an attachment member for cooperating with the neck of the first container and an opening extending therethrough. A removable second cap is attachable to the first cap to close the opening. The first cap has a perforating member surrounding its opening so that when the first container is attached to the second container, the perforating member perforates the tearable cap of the first container to allow mixing of products stored in the first and second containers after removal of a protective stopper on the first container and removal of the second cap of the second container.

12 Claims, 2 Drawing Sheets

ASSEMBLY ADAPTED FOR THE MIXING OF TWO DIFFERENT PRODUCTS STORED SEPARATELY

FIELD OF THE INVENTION

This invention relates to an assembly for mixing two different products which react with one another and consequently cannot be stored in contact with one another.

DESCRIPTION OF THE PRIOR ART

Oxidation hair dyes can be cited by way of example. In oxidation hair dyes, this the oxidant and the dye must be stored separately and are mixed only when the dye composition is applied to the hair. Oxidation dyes are presently sold in a package containing a bottle filled with oxidant, a tube filled with a dye paste, and a light tray of thermoformed plastic material in which the oxidant and the dye paste are mixed. This package generally also contains a brush for mixing the two products in the tray and for applying the mixture to the hair strand by strand.

In view of the volume of the tray, the packages are bulky, and expensive, and they cannot be packaged manually.

SUMMARY OF THE INVENTION

The present invention proposes an assembly for mixing two products and for which the package and the packaging costs are substantially reduced. In order to obtain this result, mixing is accomplished in one of the containers containing one of the products.

Therefore, this invention relates to an assembly adapted for the mixing of two different products stored separately. The assembly comprises two separate containers, each of which contains one of the products. The two containers can be assembled so as to ensure that they are placed in communication with one another, characterized in that it comprises:

1. a first container, the contents of which can be removed by manual pressure without air recirculation and which is provided with a neck to which a tearable cap is fixed. A removable stopper is fixed to the neck so as to protect the cap.
2. a second substantially rigid container, the neck of which is provided with a closure system consisting of two parts:

The first part includes a capsule fixed to the neck of the second container. A collar is opening provided in the capsule and has a perforating upper edge.

The second part includes a removable cover fixed to the capsule in order to close its collar opening and to protect the perforating edge device. The neck of the first container is threaded and capable of cooperating after removal of the stopper, with a complementary threaded element provided on the capsule of the first container. Thus, the first container can be securely screwed to the second container, such that, upon securing, the perforating device perforates the cap and allows the products to mix.

The first container is preferably a tube of flexible material. The second container, in which the user effects mixing, is preferably a wide-necked pot in the form, for example, of a bowl.

The perforating device preferably consists of a collar having a bevelled edge surrounding the opening of the capsule, but could also consist of several cutters disposed around the opening.

The fixing element provided on the neck of the first container preferably consists of a thread provided externally on the neck. The thread serves to fix the removable stopper to the neck of the first container. A first cylindrical skirt is advantageously disposed on the capsule and around the perforating device, the inner wall of which is provided with a thread complementary to the thread of the neck of the first container for fixing the first container to the capsule of the second container. The thread of the neck of the first container, therefore, serves two functions.

The first cylindrical skirt is advantageously surrounded by a second cylindrical skirt coaxial with the first, the second skirt being provided on its exterior with a fixing means complementary to the one provided on the cover for fixing the cover to the capsule. The first and second cylindrical skirts are separated by an annular housing which opens towards the exterior and may preferably receive in this zone, when the cover is fixed to the capsule, a sealing skirt provided in the interior of the cover, on the base of the latter. The first and second skirts preferably have substantially the same height, the annular housing extending substantially over the entirety of the said height.

The neck of the second container is preferably a cylinder of circular section and the capsule is fixed to the second container by virtue of the cooperation of a thread provided externally on the edge of the second container with a complementary thread provided internally on a circular cylindrical wall of the capsule. The capsule preferably comprises a sealing skirt coaxial with the cylindrical wall, the said skirt coming to rest against the inner wall of the neck of the second container. The axis of the cylindrical wall and those of the first and second skirts of the capsule coincide with one another.

The package may also contain a manual stirring apparatus for mixing the two products. This stirring apparatus preferably consists of a brush, serving both to mix the products and to apply the mixed product.

The package of the assembly according to the invention may also contain in the known manner gloves formed by heat sealing a polythene film serving to protect the hands of the user when applying the mixture, and instructions for use.

The assembly according to the invention operates as follows: At the time of use, the user removes the stopper of the first container and the cover of the capsule. He then fixes the first container to the capsule of the second container by the cooperation of the two fixing elements. During this operation, the perforating device perforates the cap fixed to the neck of the tube. The user then presses manually on the walls of the first container. The contents of the first container penetrate through the opening of the capsule into the second container. When the first container is empty, the user separates the capsule from the second container. The two products are then in the second container and the user mixes them in the said second container with a manual stirring apparatus.

The subject matter of the invention will be more readily understood from the following description of one embodiment given purely by way of a non-limiting example and with reference to the accompanying drawings, in which:

BRIEF DESCRIPTION OF THE DRAWINGS

FIG. 3 is an elevation of the capsule of the second container surmounted by the first container after emptying of the latter, and.

DETAILED DESCRIPTION OF THE INVENTION

Figure 1:
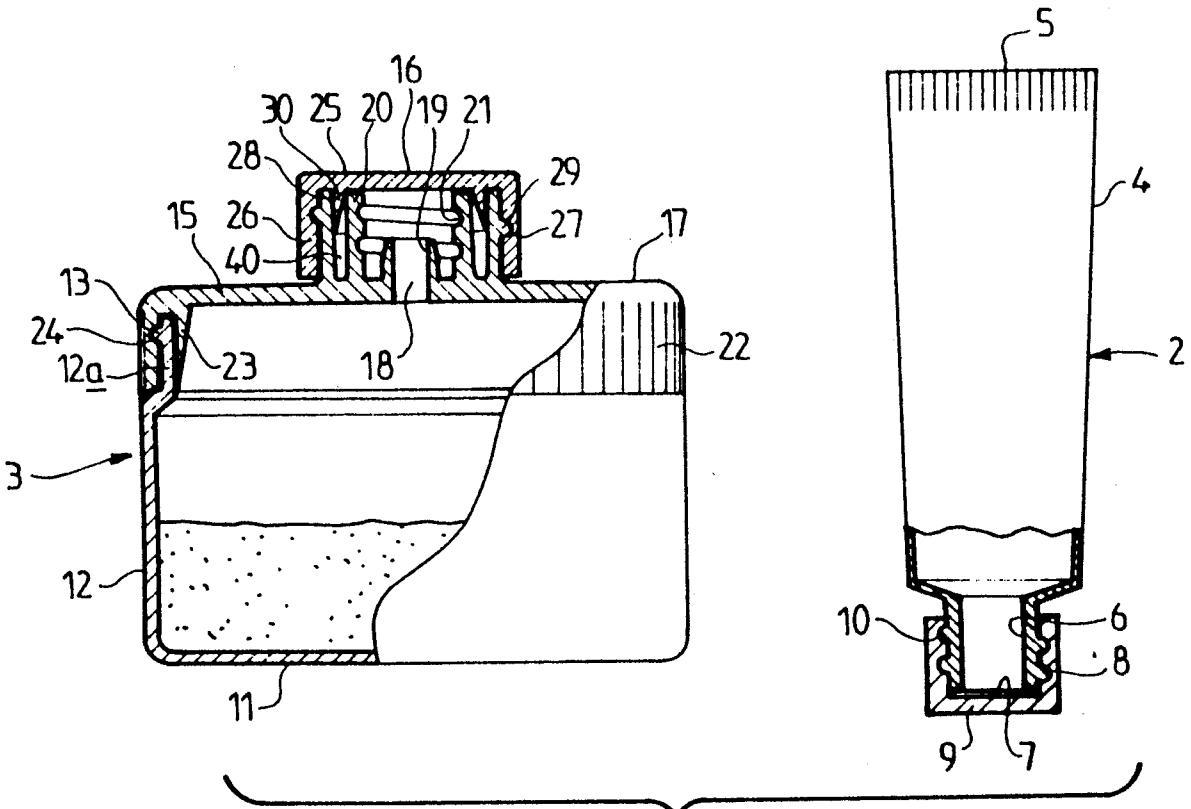
FIG. 1 is an elevation, with some broken away portions, of two containers of an assembly according to the invention.

The assembly according to the invention is packaged in a package which is not shown. It consists principally of a tube 2 and a wide-necked pot 3, forming the first and second containers respectively of the assembly according to the invention. The tube 2 contains, for example an oxidation dye paste and the pot 3 an oxidizing paste. The tube 2 has a flexible-walled tube 4 closed at one end by a welded joint 5. At the opposite end to the welded joint 5, the tube 2 has a cylindrical neck 6. A tearable cap 7 is disposed on the edge of the neck 6, which can be made in one piece with the tube or can be connected thereto. A thread 8 is provided on the external wall of the neck 6. A stopper 9 formed by a circular base provided with a cylindrical skirt is fixed to the neck 6 by means of a thread 10 which is disposed on the inner wall of the cylindrical skirt of the stopper 9 and which is complementary to the thread 8 of the neck 6.

The pot 3 is a cylindrical pot of rigid plastic material. The pot has a flat circular base 11 and a cylindrical lateral wall 12, the upper part of which (in the position shown in FIG. 1) has a smaller diameter in order to form the neck 12*a* of the pot 3. This neck 12*a* has an external thread 13. A closure system consisting of a capsule 15 and a cover 16 is fixed to the pot 3.

The capsule 15 consists of a circular plate 17 of moulded plastic material, in the center of which an axial opening 18 is formed. The opening 18 is bordered by a perforating device which consists of a collar 19 directed towards the exterior of the pot 3. The edge of collar 19 is bevelled so that it is a cutting edge. The plats 17 is provided with a first skirt 20 which is situated at a distance from the collar 19 equal, except for the necessary clearance, to the thickness of the wall of the neck 6. The skirt 20 has the same axis as the opening 18 and the collar 19. The inner wall of this first skirt 20 is provided with a thread 21 which is complementary to the thread 8 of the neck 6 of the tube 2. The skirt 20 has a height smaller than the height of the neck 6 of the tube 2, although close to the latter. The plate 17 is provided with a second cylindrical skirt 28 coaxial with the opening 18 and with the first skirt 20, surrounding the first skirt 20 and having the same height as the latter. The external wall of this second skirt 28 is provided with a thread 29. An annular housing 40 is provided between the two skirts 20 and 28 over the entire height thereof, the presence of this housing facilitating the removal of the threaded skirts. A cylindrical wall 22 is disposed on the periphery of the plate 17, directed towards the pot 3, and having an outer diameter equal to that of the lateral wall 12 of the pot in its non-narrowed part and an inner diameter equal to the outer diameter of the neck 12*a*. A thread 24 is provided on the inner face of this wall 22, which cooperates with the thread 13 of the neck 12*a* of the pot 3. A sealing skirt 23 coaxial with the cylindrical wall 22 comes to rest against the inner wall of the neck 12*a* of the container 3.

The cover 16 consists of a flat circular base 25 on the periphery of which there is disposed a cylindrical skirt 26. A thread 27 is provided on the inner face of the said skirt 26, which cooperates with the thread 29 of the skirt 28. The cover is also provided with a sealing skirt 30, having the same axis as the skirt 26. The sealing skirt 30 has an outer diameter equal to the inner diameter of the second skirt 28 and, when the cover 16 is screwed on to the capsule 15, it is positioned in the zone of the housing 40 which opens towards the exterior.

The assembly according to the invention moreover comprises a brush 31 which is packaged in the same package as the containers 2 and 3.

Figure 3:
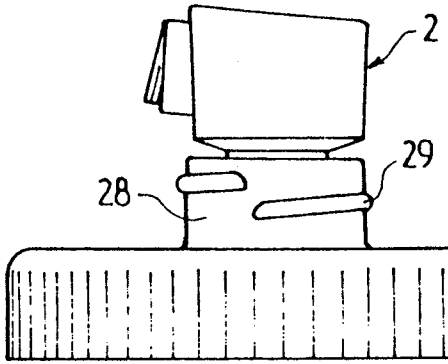
Figure 4:
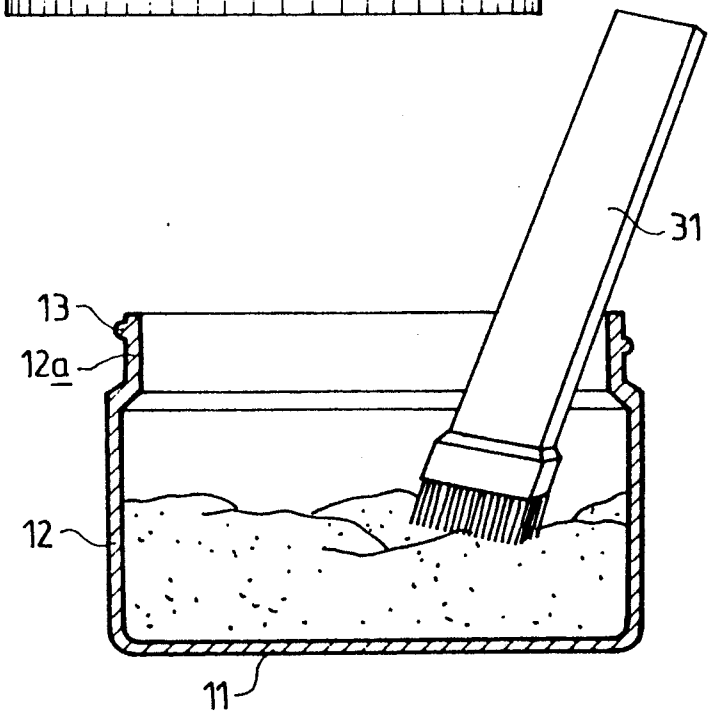
FIG. 4 is an axial section of the second container after removal of the capsule, during the mixing operation.
Figure 2:
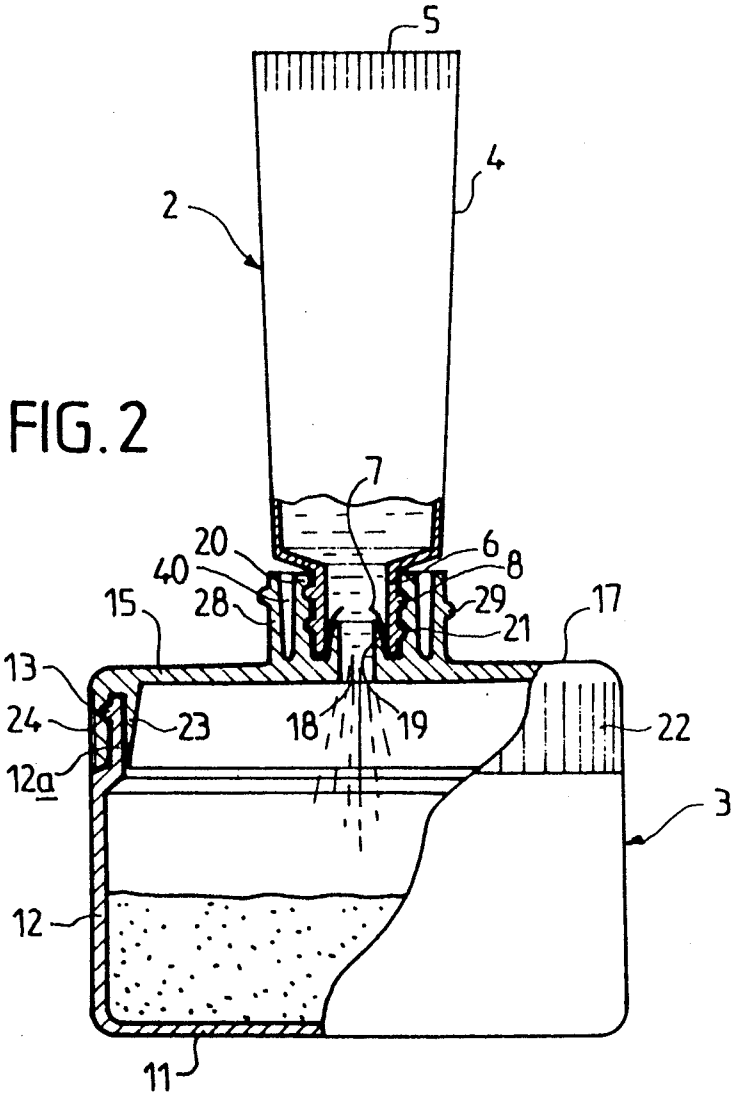
FIG. 2 is an elevation, with some broken away portions, of the two containers of the assembly of FIG. 1 after they have been assembled together.

The assembly according to the invention is used in the manner described hereinafter. The user removes the stopper 9 from the tube 2. The neck 6 is then closed only by the cap 7. He also removes the cover 16 of the closure system of the pot 3. He then screws the neck 6 of the tube 7 into the skirt 20, the thread 21 of the skirt 20 cooperating with the thread 8 of the neck 6. During this screwing operation, the collar 19 tears the cap 7 (see FIG. 2). The tube 2 and the pot 3 are then in communication with one another via the opening 18 of the capsule 15. The user then rolls up the tube 2, as illustrated in FIG. 3, and the product contained in the tube 2 passes into the pot 3, with no risk of loss of the product. The user then separates the capsule 15 from the pot 3 simply by unscrewing the threads 13, 24, the tube 2 remaining fixed to this capsule. The user can then mix the two products (dye and oxidant) in the pot 3 with the aid of the brush 31. He may leave it to rest to allow the color to develop, the mixture then being applied to the hair with the aid of the brush 31.

I claim:

1. An assembly for the mixing of two different products stored separately, said assembly comprising a first and a second container each capable of containing a separate product, said first container having a neck and a body, said neck having a tearable cap fixed thereon and a removable stopper on said neck protecting said tearable cap, said body being responsive to manual pressure to effect dispensing of the product from said first container after said cap is torn, said second container having a substantially rigid body and a neck, a first cap is attachable to said neck of said second container and having an attachment means for cooperating with said neck of said first container, said first cap having an opening extending therethrough and an edge surrounding said opening, said edge having perforating means disposed adjacent thereto, a removable second cap attachable about said attachment means and said opening in said first cap to close said opening and to protect said perforating means, said attachment means cooperable with said neck of said first container after removal of said removable stopper of said first container and removal of said second cap of said second container, so that said first container is attachable about said opening of said first cap of said second container with said perforating means perforating said tearable cap of said first container, said neck of said first container having an external thread for fixing said removable stopper thereon, said attachment means of said first cap of said second container comprising a first cylindrical skirt surrounding said perforating means and having an internal thread thereon for cooperating with said external thread of said neck of said first container.

2. The assembly as claimed in claim 1, characterized in that the first container is a tube comprised of flexible material.

3. The assembly as claimed in claims 1 or 2, characterized in that the second container is a wide-necked pot.

4. The assembly as claimed in claim 1, characterized in that the perforating means comprises a collar having a bevelled edge.

5. The assembly as claimed in claim 1, characterized in that the first cylindrical skirt is surrounded by a second cylindrical skirt coaxial with the first cylindrical skirt, said second cylindrical skirt having an exterior surface, said exterior surface being provided with a fixing means for receiving said second cap.

6. The assembly as claimed in claim 5, characterized in that the fixing means provided externally on the second cylindrical skirt is a thread, said second cap of said second container being cylindrically shaped about a longitudinal axis.

7. The assembly as claimed in claim 6 wherein said first and second cylindrical skirts are separated by an annular housing, said second cap having a base and a sealing skirt depending therefrom so that, when said second cap is mounted about said opening in said first cap said sealing skirt is received in said annular housing.

8. The assembly as claimed in claim 7, characterized in that the first and second cylindrical skirts having substantially the same height, the annular housing extending substantially over the entirety of said height.

9. The assembly as claimed in claim 5 wherein said neck of said second container is cylindrical said first cap has a threaded interior and said neck of said second container is provided with external threads for cooperation with said threaded interior of said first cap.

10. The assembly as claimed in claim 9, wherein said first cap has a cylindrical side wall and a sealing skirt coaxial with said cylindrical side wall positioned to sealingly engage said neck of said second container.

11. The assembly as claimed in claim 9, wherein said threaded interior of said first cap and said first and second skirts of said first cap are coaxially formed relative to one another.

12. The assembly as claimed in claim 1 characterized in that the assembly further comprises a manual stirring apparatus for mixing two products in the second container.

* * * * *